United States Patent [19]

Emmons et al.

[11] Patent Number: 4,929,377

[45] Date of Patent: May 29, 1990

[54] STABLE, AQUEOUS BLEACH COMPOSITIONS CONTAINING SOLID ORGANIC PEROXY ACID

[75] Inventors: Stuart A. Emmons, Tremeirchion; Perry Hale, Wallasey, both of Great Britain

[73] Assignee: Lever Brothers Company, New York, N.Y.

[21] Appl. No.: 313,408

[22] Filed: Feb. 21, 1989

[30] Foreign Application Priority Data

Mar. 1, 1988 [GB] United Kingdom ..... 8806704

[51] Int. Cl.[5] ..... C11D 1/14; C11D 3/39

[52] U.S. Cl. ..... 251/100; 252/95; 252/186.26; 252/186.27; 252/186.28; 252/186.42; 252/186.43; 252/554; 252/DIG. 14

[58] Field of Search ..... 252/95, 100, 186.42, 252/554, DIG. 14, 186.23, 186.43

[56] References Cited

U.S. PATENT DOCUMENTS 4,264,466 4/1981 Carleton et al. ..... 252/99
4,642,198 2/1987 Humphreys et al. ..... 252/94
4,655,781 4/1987 Hsieh et al. ..... 8/111
4,822,510 4/1989 Madison et al. ..... 252/95
4,824,592 4/1989 Rerek et al. ..... 252/95
4,828,747 5/1989 Rerek et al. ..... 252/95

FOREIGN PATENT DOCUMENTS 0160342 4/1985 European Pat. Off. .
0201958 5/1985 European Pat. Off. .
0176124 4/1986 European Pat. Off. .
0240481 3/1987 European Pat. Off. .
2179053 2/1987 United Kingdom .

*Primary Examiner*—Prince E. Willis
*Attorney, Agent, or Firm*—Milton L. Honig

[57] ABSTRACT

An aqueous, liquid bleaching composition is described having a pH of from 2 to 6 and comprising a solid, particulate, substantially water-insoluble, organic peroxy acid such as diperoxy dodecane dioic acid. This peroxy acid is stably suspended in an aqueous liquid by a structuring combination of a secondary $C_{10}$-$C_{20}$ alkane sulphonate, an ethoxylated fatty alcohol and sodium sulphate.

9 Claims, No Drawings

STABLE, AQUEOUS BLEACH COMPOSITIONS CONTAINING SOLID ORGANIC PEROXY ACID

This invention relates to stable, aqueous, liquid bleach compositions containing a solid, organic peroxy acid, which can be used for effective bleaching of fabrics, hard surfaces or other substrates, either by themselves or in combination with a cleaning detergent composition.

Liquid bleaching and detergent compositions have significant advantages over solid compositions as regards both preparation and use. Their preparation does not require cost-increasing shaping steps, such as drying and granulation, and the liquid form contributes to ease of handling, dispensing and solubility, and settles dusting problems.

Aqueous, liquid bleach compositions comprising a solid, particulate organic peroxy acid suspended in an acidic aqueous liquid containing a surfactant are known in the art.

EP-A-0160342 (UNILEVER) discloses such liquid bleach compositions containing a surfactant and an electrolyte.

EP-A-176124 (AKZO) discloses aqueous, liquid bleaching compositions containing a peroxy dicarboxylic acid and an alkyl benzene sulphonate surfactant.

EP-A-0201958 (AKZO) discloses aqueous, liquid detergent and bleaching compositions containing a linear alkyl benzene sulphonate surfactant, an ethoxylated fatty alcohol and a peroxydicarboxylic acid.

EP-A-0240481 (PROCTER & GAMBLE) discloses aqueous, liquid bleach compositions containing diperoxy acid particles, $C_{11}$–$C_{13}$ linear alkyl benzene sulphonate surfactant, magnesium sulphate and water.

Conspicuously, all these liquid peroxy acid bleach compositions of the art use alkyl benzene sulphonate as the primary surfactant in the suspending liquid. Alkyl benzene sulphonates as a class are very suitable primary surfactants for structuring liquids capable of suspending solids, because of their great flexibility and independency of formulation changes; they are, however, insufficiently biodegradable. Another drawback of the compositions of the art is that they tend to suffer from instability problems at slightly elevated temperatures. There is thus a continuing need for the development of physically and chemically stable, aqueous, liquid peroxy acid bleaches which are environmentally more acceptable. Though various anionic surfactants are known which are environmentally more acceptable than alkyl benzene sulphonates, they are either less chemically stable or less effective structurants.

It has now been found that an improved physically and chemically stable, aqueous, liquid peroxy acid bleach composition can be obtained by using a surfactant mixture comprising a secondary alkane sulphonate and an ethoxylated fatty alcohol in certain weight ratios. Accordingly, the invention provides a stable, aqueous, liquid bleach composition comprising:

(a) from 1.5 to 20% by weight of a solid, particulate, substantially water-insoluble, organic peroxy acid;

(b) from 2 to 20% by weight of a surfactant mixture consisting of a secondary $C_{10}$–$C_{20}$ alkane sulphonate (SAS) and an ethoxylated fatty alcohol (NI) in a weight ratio of from 5:5 to 9:1;

(c) from 7 to 16% by weight of sodium sulphate, said composition having a pH of from about 2 to about 6 and a viscosity of from about 50 to about 1000 cps. (0.05 PaS to 1.0 PaS) measured at a shear rate of 21 second$^{-1}$ at 20° C.

A preferred composition according to the invention will comprise:

(a) from 4 to 15% by weight of said peroxy acid;

(b) from 5 to 15% by weight of said surfactant mixture in a weight ratio of from 6:4 to 8:2;

(c) from 10 to 15% by weight of sodium sulphate; and have a pH of from about 3.0 to 5.0, preferably from 3.5 to 4.5%.

A lower pH range of from 2 to 3.5 is of advantage for improved disinfecting and hygiene purposes in the cleaning and bleaching of hard surfaces.

The liquid bleach compositions herein contain as bleaching agent a solid, particulate, substantially water-insoluble, organic peroxy acid. By "substantially water-insoluble" is meant here a water-solubility of less than about 1% by weight at ambient temperature. In general, peroxy acids containing at least about 7 carbon atoms are sufficiently insoluble in water for use herein.

These materials have the general formula:

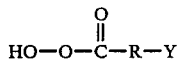

wherein R is an alkylene or substituted alkylene group containing from 6 to about 20 carbon atoms or a phenylene or substituted phenylene group, and Y is hydrogen, halogen, alkyl, aryl or

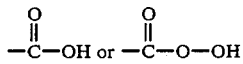

The organic peroxy acids usable in the present invention can contain either one or two peroxy groups and can be either aliphatic or aromatic. When the organic peroxy acid is aliphatic, the unsubstituted acid has the general formula:

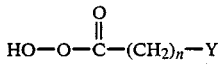

where Y can be, for example, H, $CH_3$, $CH_2Cl$, COOH, or COOOH; and n is an integer from 6 to 20.

When the organic peroxy acid is aromatic, the unsubstituted acid has the general formula:

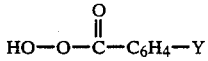

wherein Y is hydrogen, alkyl, alkyl halogen or halogen, or COOH or COOOH.

Typical monoperoxy acids useful herein include alkyl peroxy acids, alkenyl peroxy acids and aryl peroxy acids such as:

(i) peroxy benzoic acid and ring-substituted peroxy benzoic acids, e.g. peroxy-alpha-naphthoic acid;

(ii) aliphatic and substituted aliphatic monoperoxy acids, e.g. peroxy lauric acid and peroxy stearic acid.

Typical diperoxy acids useful herein include alkyl diperoxy acids, alkenyl diperoxy acids and aryl diperoxy acids, such as (iii) 1,12-diperoxy dodecane dioic acid;

(iv) 1,9-diperoxy azelaic acid;

(v) diperoxy brassylic acid; diperoxy sebasic acid and diperoxy isophthalic acid;

(vi) 2-decyl diperoxy butane-1,4-dioic acid;

(vii) 4,4[1]-sulphonyl bisperoxy benzoic acid.

A particularly preferred peroxy acid for use herein is 1,12-diperoxy dodecane dioic acid (DPDA).

The particle size of the peroxy acid used in the present invention is not crucial and can be from about 0.5 to 1000 microns, though a small particle size, such as e.g. from 0.5 to 15 microns, is favoured for laundering applications.

The secondary alkane sulphonates (SAS) used herein are n-alkane sulphonates with the formula:

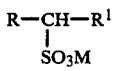

wherein R and $R^1$ are alkyl groups having together 9–19 carbon atoms; and M is an alkali metal, particularly sodium or potassium. They can be obtained by sulphoxidation of n-paraffins of the appropriate chain length and are available from Hoechst under the trade-mark Hostapur SAS of various grades, e.g. Hostapur SAS 30, 60 and 93.

A preferred SAS material is sodium secondary $C_{12}$–$C_{18}$ alkane sulphonate, particularly $C_{13}$–$C_{17}$ secondary alkane sulphonate.

The NI material used herein is preferably an ethoxylated fatty alcohol having a Hydrophilic-Lipophilic Balance (HLB) of not more than 10.5, preferably an HLB of between 6 and 10, particularly from 8–8.5.

An example of suitable NI material is commercially available under the name of Synperonic A3 supplied by ICI (Synperonic is a trade-mark), which is a fatty alcohol-3 ethylene oxide having an HLB of 8.3.

The composition of the invention can contain, and preferably does, hydrogen peroxide in an amount of approximatively 1–10% by weight of $H_2O_2$, particularly about 5% by weight, which is surprisingly stable in the composition. Hydrogen peroxide provides improvement of bleach performance at higher temperatures. When hydrogen peroxide is present, the level of surface-active agent should preferably be not in excess of 10% by weight.

Since metal ion impurities (e.g. copper and iron) can catalyze peroxy acid decomposition in the liquid bleaching composition, certain metal ion complexing agents can be incorporated to remove metal ion contaminants from the composition. It is thus desirable to include a metal complexing agent in the composition. Such agents are preferably present in an amount ranging from 0.005% to about 1.0% by weight.

Examples of useful metal ion complexing agents include dipicolinic acid, with or without a synergistic amount of a water-soluble phosphate salt; dipicolinic acid N-oxide; picolinic acid, ethylene diamine tetraacetic acid (EDTA) and its salts; various organic phosphonic acids or phosphonates such as ethylene diamine tetra-(methylene phosphonic acid) and diethylene triamine penta-(methylene phosphonic acid).

Other metal complexing agents known in the art may also be useful, the effectiveness of which may depend strongly on the pH of the final formulation. Generally, and for most purposes, levels of metal ion complexing agents in the range of from about 10–1000 ppm are already effective for removing the metal ion contaminants.

In addition to the components discussed above, the liquid bleaching compositions of the invention may also contain certain optional ingredients in minor amounts, depending on the purpose of use. Typical examples of optional ingredients are suds-controlling agents, fluorescers, perfumes, colouring agents, abrasives, hydrotropes and antioxidants. Also other surfactants may desirably be incorporated in minor amounts to the primary surfactants. However, any such optional ingredient may be incorporated provided that its presence in the composition does not significantly reduce the chemical and physical stability of the peroxy acid in the suspending system.

EXAMPLE I

The following composition was prepared by suspending DPDA in the aqueous surfactant liquid.

| Components | % by weight |
|---|---|
| 1,12-diperoxy dodecane dioic acid (DPDA) | 10.0 |
| Secondary $C_{13}$–$C_{17}$ alkane sulphonate (SAS) | 5.1 |
| Fatty alcohol-3 ethylene oxide (Synperonic A3) ® | 0.9 |
| Sodium sulphate | 10.0 |
| Ethylene diamine tetra (methylene phosphonic acid) | 0.04 |
| Water | balance to 100% |

The pH of this formulation was adjusted to 4.5.

Viscosity=0.450 PaS.

The liquid was easily pourable and showed excellent stability upon storage, both physically and chemically.

EXAMPLE II

The following composition was equally easily pourable and of excellent stability upon storage, both physically and chemically.

| Components | % by weight |
|---|---|
| DPDA | 10 |
| SAS | 5.1 |
| Synperonic A3 | 0.9 |
| Hydrogen peroxide ($H_2O_2$) | 5.0 |
| Silicone oil (DB 100 ex Dow Corning) | 0.5 |
| Ethylene diamine tetra (methylene phosphonic acid) | 0.05 |
| Sodium sulphate | 10.0 |
| Water | balance to 100% |

pH adjusted to 4.5 and 3.5

Viscosity=0.450 PaS

The product having pH 3.5 can advantageously be used as disinfectant in the cleaning of e.g. hard surfaces.

We claim:

1. An aqueous, liquid, bleach composition having a pH of from about 2 to about 6 and a viscosity of from about 0.05 to about 1.0 PaS, measured at a shear rate of 21 second$^{-1}$ at 20° C., comprising:

(a) from 1.5 to 20% by weight of a solid, particulate, substantially water-insoluble, organic peroxy acid;

(b) from 2.0 to 20% by weight of a surfactant mixture consisting of a secondary $C_{10}$–$C_{20}$ alkane sulphonate (SAS) and an ethoxylated fatty alcohol (NI) having a Hydrophilic-Lipophilic Balance (HLB) of not more than 10.5 in a weight ratio of from 5:5 to 9:1; and (c) from 7 to 16% by weight of sodium sulphate.

2. A composition according to claim 1, wherein said peroxy acid is 1,12-diperoxy dodecane dioic acid.

3. A composition according to claim 1, wherein said secondary alkane sulphonate is sodium secondary $C_{12}$–$C_{18}$ alkane sulfonate.

4. A composition according to claim 1, wherein said secondary alkane sulphonate is sodium secondary $C_{13}$–$C_{17}$ alkane sulphonate.

5. A composition according to claim 1, wherein said HLB is between 6 and 10.

6. A composition according claim 1, wherein said HLB is from 8–8.5.

7. A composition according to claim 1, comprising:

(a) from 4 to 15% by weight of said peroxy acid;

(b) from 5 to 15% by weight of said surfactant mixture in a weight ratio of from 6:4 to 8:2; and (c) from 10 to 15% by weight of sodium sulphate, and having a pH of from about 3.0 to 5.0.

8. A composition according to claim 7, wherein said pH is from 3.5 to 4.5.

9. A composition according to claim 1, which further comprises from about 1 to 10% by weight of hydrogen peroxide.

* * * * *